United States Patent [19]

Rejsa et al.

[11] 3,938,301

[45] Feb. 17, 1976

[54] APPARATUS FOR INSERTING SEPARATOR PLATES IN CANS AND TAMPING THEM IN PLACE

[75] Inventors: Jack J. Rejsa; Francis R. Reid, both of Minneapolis, Minn.

[73] Assignee: The Pillsbury Company, Minneapolis, Minn.

[22] Filed: Apr. 4, 1975

[21] Appl. No.: 564,238

[52] U.S. Cl. ..... 53/157; 53/167; 53/320; 29/208 B

[51] Int. Cl.[2]..... B65B 61/20; B65B 61/22

[58] Field of Search ..... 53/157, 167, 308, 319, 53/320, 321, 328, 342; 29/208 B, 211 R

[56] References Cited

UNITED STATES PATENTS

| | | | |
|---|---|---|---|
| 1,125,041 | 1/1915 | Beadle | 53/319 X |
| 1,553,738 | 9/1925 | Arey | 53/328 |
| 2,840,970 | 7/1958 | Brown | 53/328 X |
| 3,432,989 | 3/1969 | Bouzereau | 53/328 X |
| 3,715,865 | 2/1973 | Davis | 53/319 |
| 3,840,966 | 6/1973 | Reid et al. | 29/208 B |

*Primary Examiner*—Travis S. McGehee
*Assistant Examiner*—Horace M. Culver
*Attorney, Agent, or Firm*—James V. Harmon; Michael D. Ellwein

[57] ABSTRACT

An apparatus is described for inserting separator plates into cans and tamping them into place within the can body. A plurality of insertion heads are provided each with a vacuum supply for holding one of the separator plates on its free end. The can bodies are guided in succession to the apparatus and a positioning device such as a star wheel is provided for engaging each of the can bodies and aligning each can body with the longitudinal axis of the insertion head. Relative motion is then established between the can body and the insertion head along its longitudinal axis in the proper direction to transfer the separator plate into the can body. The vacuum is then released and the can is dropped away from the insertion head.

7 Claims, 8 Drawing Figures

APPARATUS FOR INSERTING SEPARATOR PLATES IN CANS AND TAMPING THEM IN PLACE

FIELD OF THE INVENTION

The invention relates to can filling equipment and more particularly to an apparatus for inserting and tamping in place the circular separator plate used for separating food items contained in the can.

THE PRIOR ART

Food products are sometimes packed in cups and inserted in a can as described in U.S. Pat. No. 3,851,757 or, if desired, placed in the can without a cup, i.e. in a loose condition particularly if granular such as a sugar and nut topping. In either case, it is often necessary to separate the food product from biscuits or other foods contained in the can. This function is provided by a circular separator plate or disk interposed between the food products.

Existing equipment for inserting separator plates of this kind and locating them in the desired position includes a plurality of insertion heads mounted upon a rotating turret. Each head is slidable upon the turret along its longitudinal axis and is operated by a cam mechanism so that as the turret revolves the insertion heads are slid up and down by the cam along circumferentially spaced longitudinal axes on the periphery of the turret. As each one of the heads is moved into a can by its operating cam, it pushes a separator plate into the can. There are several deficiencies in this prior equipment. First, the reciprocal motion of the insertion heads produced by the cam and accompanying stresses and vibration limits the speed of operation so that each machine can insert only about 100 separator plates per minute whereas an operating speed of about 400 plates or more per minute is desired. Another problem was that air sometimes became trapped and compressed under a separator plate as it was forced into the can. The trapped air sometimes pushed the separator plate partially out of the can after the insertion head was withdrawn. Another problem was that the separators were sometimes tilted in the cans. Moreover, the rapid reciprocation of the inserting heads through a distance of about 4–5 inches tended to produce excessive wear and to make maintenance of the equipment more difficult.

THE OBJECTS

The main objects are: (a) to insert separator plates or disks into can bodies at speeds up to 400 or more per minute, (b) to insert the separator plates without the insertion heads having to reciprocate, (c) to prevent the accumulation and compression of air or other gas under the separator plates, (d) to insert the separator plates so that the separator plates are oriented at an oblique angle with respect to the axis of the can by the provision of a tilting support on the head, (e) a further provision for tilting the support normal to the can axis after the plate is in place, (f) a safety means associated with the vacuum used for holding the plates in place on the heads to prevent food from being drawn into the separator head in the event one of the separator plates is missing.

THE FIGURES

SUMMARY OF THE INVENTION

Figure 1:
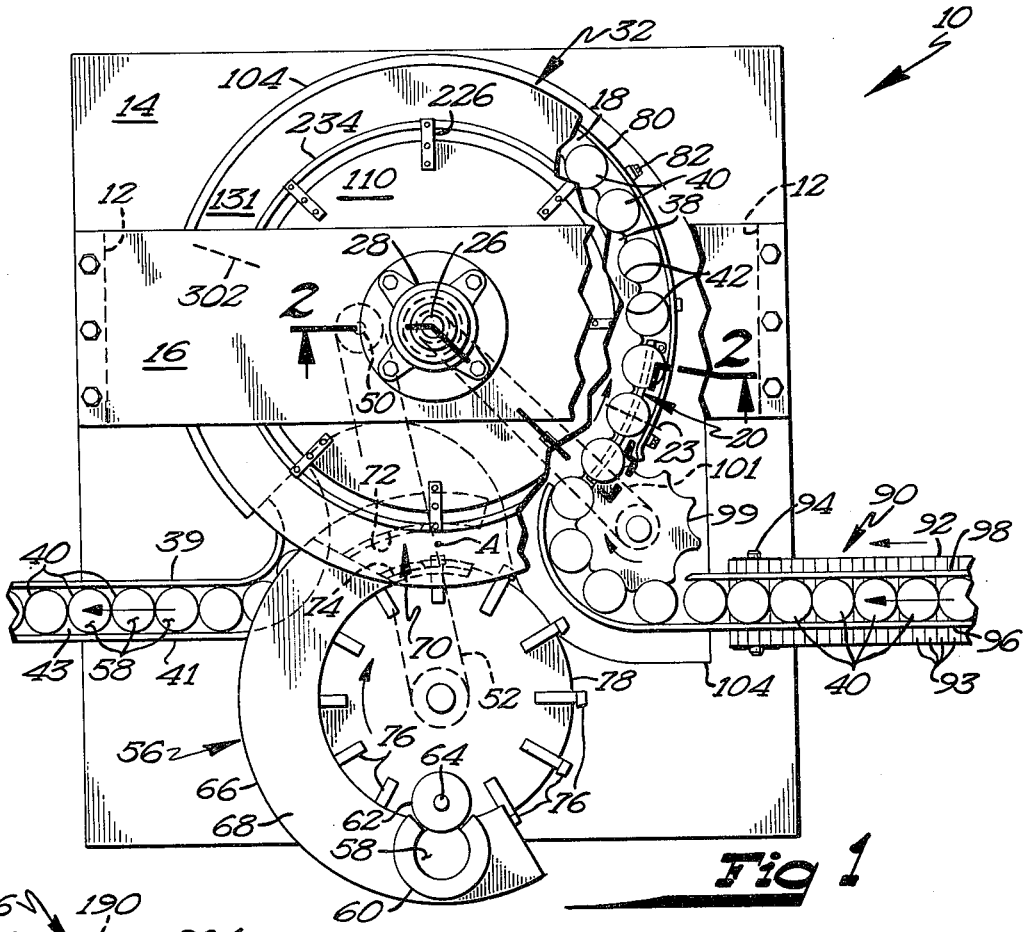
FIG. 1 is a plan view of the apparatus.
Figure 5:
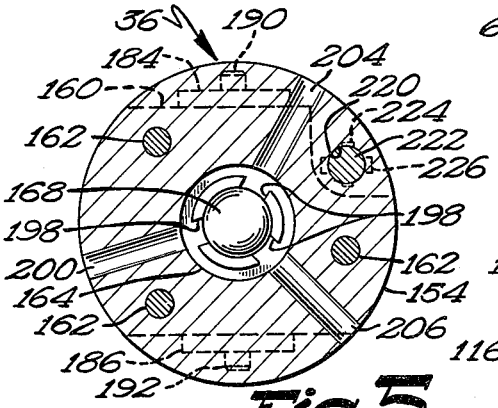
FIG. 5 is a horizontal, cross sectional view taken on line 5—5 of FIG. 4.
Figure 7:
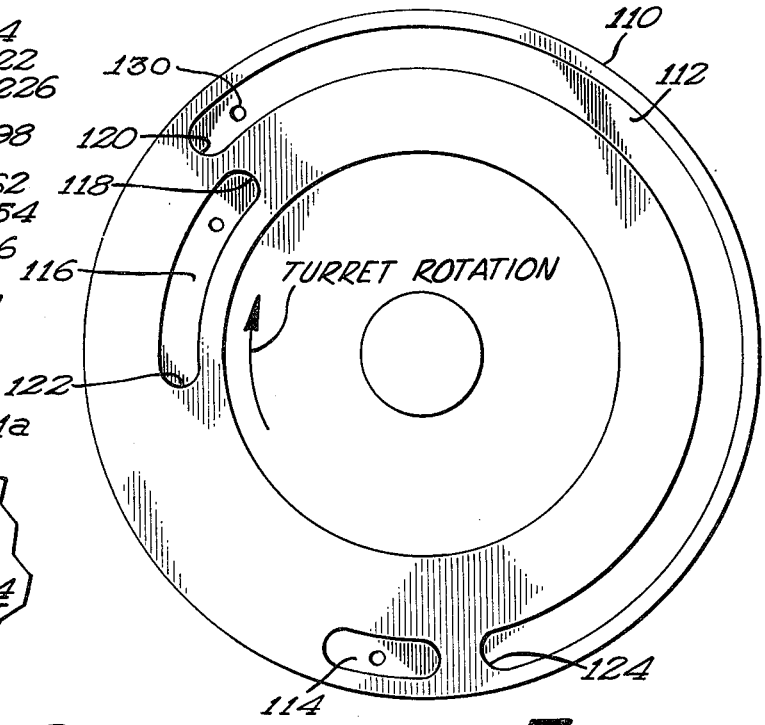
FIG. 7 is a horizontal sectional view from below taken on line 7—7 of FIG. 2.
Figure 8:
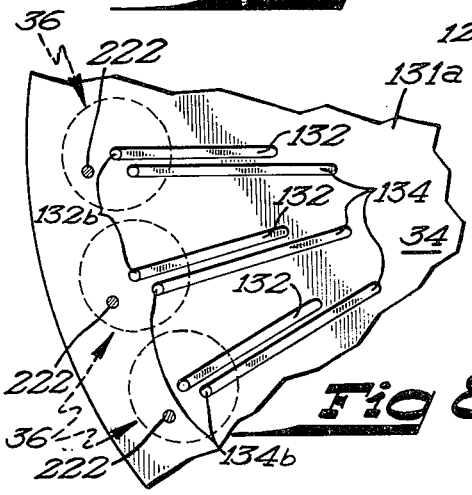
FIG. 8 is a partial horizontal sectional view taken on line 8—8 of FIG. 2.

An apparatus is described for inserting separator plates into cans and for tamping them into place within the can body. At least one insertion head is provided each with a vacuum supply for holding one of the separator plates on its free end. A means is preferably provided for guiding the can bodies in succession to the apparatus and a positioning device such as a star wheel engages each of the can bodies and aligns it with the longitudinal axis of the insertion head. Relative motion is then established between the can body and the insertion head along its longitudinal axis in the proper direction to transfer the separator plate into the can body. The vacuum is then released and the can is separated from the insertion head.

In a preferred form of the invention, a tiltable separator support is pivotally mounted on the free end of the insertion head for holding the separator plate at a slight oblique angle with respect to the axis of the can body.

It is also preferred to secure the separator plate to the insertion head with vacuum means and to provide a vacuum duct within the head that communicates through an opening at the free end of the head to establish sufficient suction at the end of the head when the vacuum is applied to hold one of the separator plates against the insertion head. A valve means is preferably provided in the duct for turning the vacuum on to secure the separator plate to the head and for turning the vacuum off when the head and plate has assumed the desired position in the can body. It is also preferred that a check valve be provided in the air duct to close when there is no plate on the end of the insertion head to prevent food from being sucked into the vacuum duct.

A preferred form of the invention also includes a provision for establishing a vacuum within the can itself when the head is introduced into the can to thereby draw the can onto the insertion head and thus avoid having to reciprocate the insertion head.

In the accomplishment of the foregoing and related ends, the invention then comprises the features hereinafter fully described and particularly pointed out in the claims, the following description setting forth in detail certain illustrative embodiments of the invention, these being indicative, however, of but a few of the various ways in which the principles of the invention may be employed.

DESCRIPTION OF A PREFERRED EMBODIMENT

The apparatus includes a supporting framework 10 including two vertical laterally spaced disposed plates 12 which are rigidly connected to a base plate 14 supported on legs 15 only one of which is shown and a horizontally disposed upper frame member 16 at the top, not all of which is shown for the sake of simplicity and because the framework can be of any suitable known construction. Mounted upon the base plate 14 is a cam support platform 18 which is secured rigidly in place in any known manner. On the upper surface of the platform 18 is a ramp or cam rail 20 which is circular as seen from above. It includes a horizontal section 22 and an inclined ramp section 24 as seen from the side. The point of intersection 23 between the ramp 24 and the flat section 22 of the cam is designated by a dotted line 23 in FIG. 1. The cam rail 20 is secured in place in any suitable manner as by bolts. The purpose and operation of the cam rail will be described more fully below.

Figure 2:
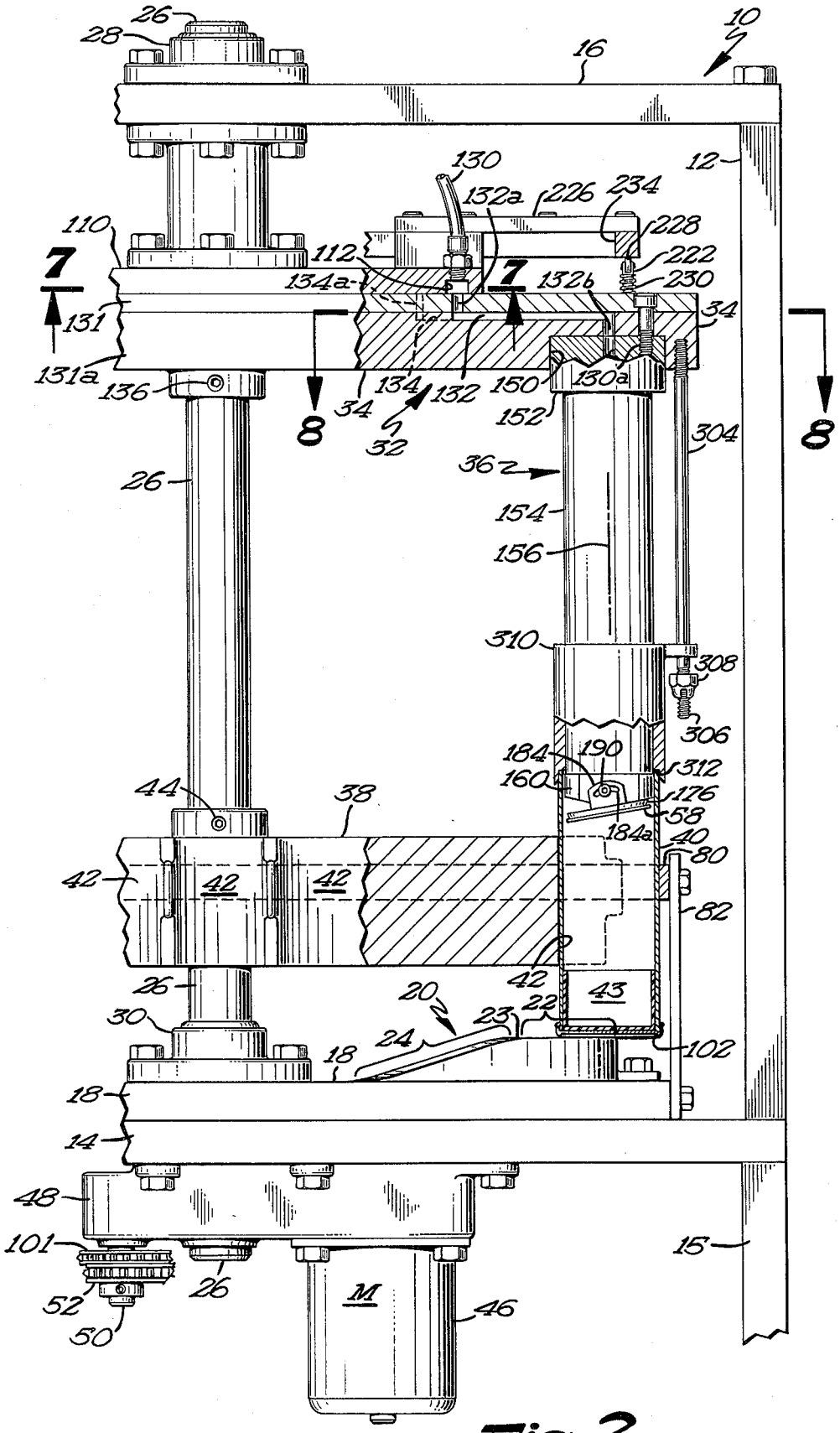
FIG. 2 is a partial vertical sectional view taken on line 2—2 of FIG. 1.
Figure 3:
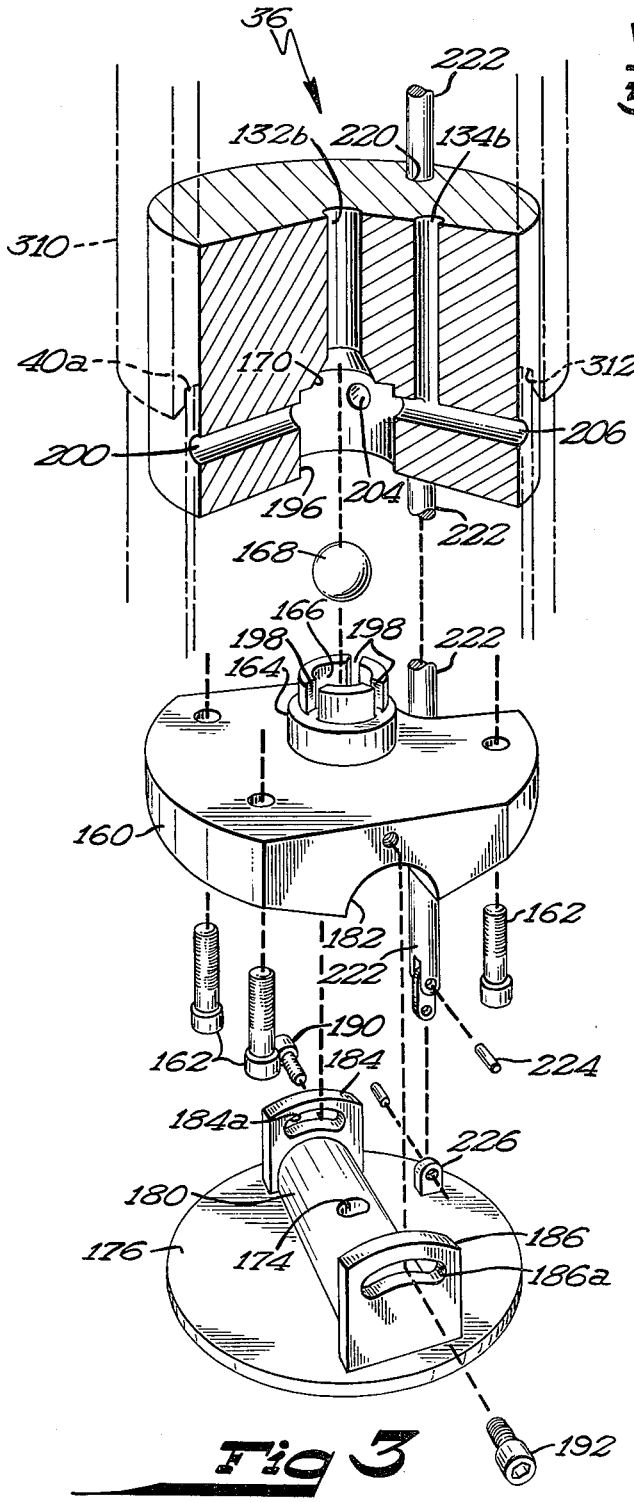
FIG. 3 is an enlarged exploded view of the lower end of the separator plate insertion head.

Mounted upon the supporting framework upon a vertically disposed axle 26 that extends through bearings 28 and 30 within the plates 16 and 14 respectively is a turret 32 that includes two major components; an insertion head mounting platform 34 to which are secured a plurality of circumferentially distributed, vertically disposed insertion heads 36 and a star wheel 38 which functions as a means to engage the can bodies to align each can body with the longitudinal axis of one of the insertion heads. The can bodies are designated 40 and can be seen entering the apparatus on the right side as viewed in FIG. 1 and positioned below an insertion head as seen in FIG. 2.

The star wheel 38 will now be described in detail. As seen in FIGS. 1 and 2, the star wheel is provided with a plurality of semi-cylindrical pockets 42 the axis of each being aligned with the axis of an insertion head and parallel to the axis of the turret and its axle 26. Each pocket 42 is spaced circumferentially about the periphery of the wheel 38 at equally spaced intervals to engage and align each can body with one of the insertion heads 36 which is located coaxial therewith and immediately above the can when located as shown on the star wheel 38.

A circular guide rail 80 positioned in a horizontal plane and supported from the platform 18 by vertical supporting posts 82 (only one of which is shown) holds the can bodies 40 in their proper places within the pockets 42 as the star wheel 38 rotates.

On the lower left side of the turret as seen in FIG. 1 is an outlet passage for the cans containing the separator plates formed by side walls 39 and 41 and a bottom wall 43. It is through this exit passage that the cans pass out of the aparatus.

The star wheel 38 is secured rigidly to the shaft 26 in any suitable manner as by means of a key (not shown) and set screw 44 and rotates with the shaft as it is driven by a motor 46 through speed reducer 48 which also turns a counter shaft 50 in turn connected to a chain and sprocket assembly 52 to drive a separator plate feeder 56 of known construction. One suitable commercially available feeder for this purpose is a lid feeder for a can seaming machine such as the lid feeders made by the Angeles Sanitary Can Machine Company of Los Angeles California. Although the separator feeder forms no part of the present invention by itself, for the sake of clear understanding it will be briefly described. The general objective is to deliver separator plates 58 in succession to the loading station designated point A where they are picked up by the separator plate insertion heads 36.

Briefly, the separator feeder comprises a vertically disposed magazine 60 in which a plurality of the separator plates 58 are held in a stacked arrangement, one above the other, a rotating pick-up wheel 62 which as it rotates at a constant speed on shaft 64 causes the separators 58 to drop from the stack in the magazine 60 one at a time into a guide tract 66 having a cover plate 68 and a circular channel 70 with outward and inward side edges 72 and 74 respectively that are in contact with the edges of the separator plates as they are advanced in a clockwise direction through the channel by pusher fingers 76 on rotating wheel 78. The wheel 78 is driven at a constant speed by the chain and sprocket assembly 52 to thereby deliver the separator plates one after the other in rapid succession to the loading point A where each one comes into vertical alignment with the lower end of the insertion head 36 and spaced about ¼ inch or preferably less below it. The speed of rotation of the feeder 56 is set so that the separators move at the same linear speed as the insertion heads 36.

The feed-in arrangement for the cans 40 will now be described. As seen in FIG. 1, there is provided a table top chain conveyor 90 only a part of which is shown having horizontal upper surface 92 consisting of a plurality of conveyor elements 93 entrained over a sprocket assembly at the left end thereof mounted upon an axle 94. The containers 40 resting upon conveyor 90 are conveyed from right to left in the figures between stationary guide bars 96 and 98 which together with the rotating star wheel 99 feed the cans 40 one at a time toward the left and then toward the turret into each successive recess 42 in the star wheel 38. The star wheel 99 is suitably driven by a chain or other mechanical connection 101 (FIG. 1) with the turret shaft 26 at the same peripheral speed as star wheel 38. The cans 40 are initially closed at their bottom ends by means of a bottom closure or cover 102 which is crimped to the lower end and this bottom cover slides along the support plate 104 (FIG. 1) as the star wheel 99 rotates in synchronization with the turret. The cans soon contact the inclined section 24 of the ramp or cam rail 20 and are thereby elevated so that their upper edges are in contact with sleeve recess 312.

The inserting heads 36 and their supporting structure will now be described with reference to FIGS. 2, 4, 6 and 7. As seen best in FIG. 7, there is rigidly secured to the supporting framework stationary air supply manifold 110 containing two arcuate vacuum chambers 112 and 116 each lying in a horizontal plane and a compressed air chamber 114. The vacuum chamber 116 functions to initially secure the separator plate to the lower end of the insertion head as will be described below. It forms a relatively small arc e.g. 45° and is positioned in overlapping relationship with vacuum chamber 112. The separator vacuum chamber 116 end point 122 is located in vertical alignment with the transfer point A (FIG. 1) where the separator plate transfers from the guide tract 70 to the lower end of the inserter head. Each of the chambers 112, 114 and 116 in the manifold 110 opens downwardly.

Air and vacuum is supplied to the chambers through suitable supply lines such as a vacuum line 130 (FIG. 2). Mounted rigidly upon the axle 26 immediately below the manifold 110 are a pair of contacting horizontal circular plates 131a and 131 which together form the mounting plate 34. These plates are secured together for example by means of bolts **130*a* (only one of which is shown) and are also affixed to the shaft 26 for example by means of a set screw 136 and key (not shown). Within the plate 131***a* are a plurality of radially extending ducts 132 each of which communicates at its outward end with a duct 132*b* leading vertically through the insertion head 36. At its inward end, each channel 132 communicates through vertically disposed transfer port 132*a* in the plate 131 with the chambers 112 and 114. Channels 134 communicate with a vertical duct 134*b* in head 36 and through port 134*a* of plate 131 with channel 116. In this way, the compressed air is transferred from chamber 114 into the insertion heads when required through channels 132 and the vacuum is applied when required through both channels 132 and 134. The chambers in this way cooperate with the channels to serve as valves.

Figure 4:
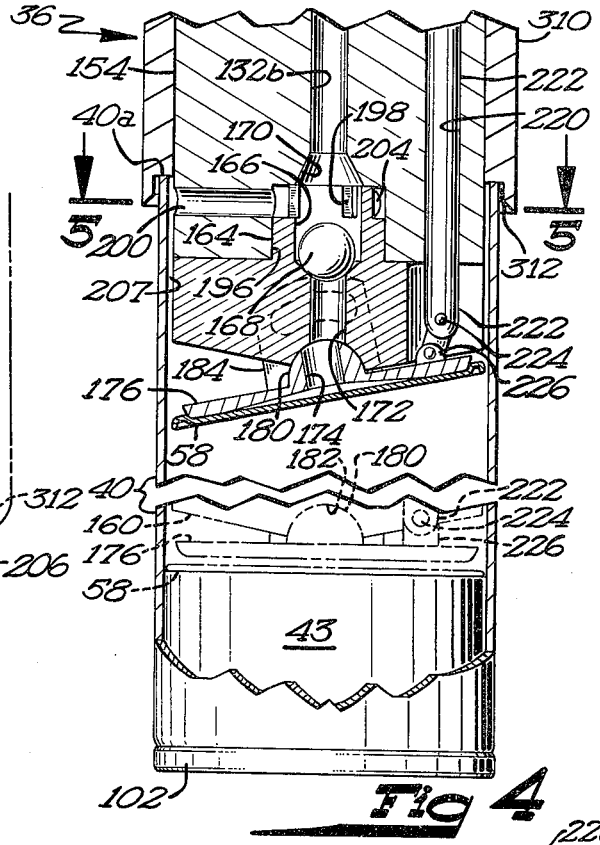
FIG. 4 is a partial, vertical sectional view of the insertion head with the can body as it appears when it just begins to slide onto the insertion head.

The insertion heads will now be described with particular reference to FIGS. 2, 3, 4, 5 and 6. The lower surface of the plate 131*a* is provided a plurality of shallow cylindrical bores 150 each disposed vertically and distributed equi-distant from the center of the turret and spaced circumferentially thereon. It is into this bore 150 that the upper end portion 152 (somewhat enlarged with respect to the body portion 154 of each inserting head 36) is suitably secured for example by one of the bolts 130*a*. The body of the insertion head is an elongated cylinder having a longitudinal axis 156 that is disposed vertically and parallel to the axis of the turret and axle 26. The lower i.e. free end of the inserter head is composed of an end piece 160 which is also cylindrical as seen from above and is fastened to the lower end of the inserter head by means of bolts 162. The end piece 160 is provided with a vertically disposed upwardly extending circular collar 164 which is bored centrally at 166 to form a check valve chamber that contains a ball 168 and includes upper and lower seats 170 and 171 respectively, the former being formed by the lower open end of the duct 132*b*. A duct 172 extends downwardly from chamber 166 and communicates through an opening 174 in the center of a tiltable support plate 176 which is circular as seen from above and is slightly smaller in diameter than the insertion head 36 itself. The tiltable support plate is of just sufficient size to support one of the separator plates 58 as seen in FIG. 4 and is mounted for pivotable movement about a horizontal axis at the lower end of the insertion head by the provision of a semi-cylindrical upward projection 180 which fits into a corresponding semi-cylindrical recess 182 in the lower surface of the end piece 160. Support 176 is held in place by vertically disposed parallel and horizontally spaced mounting plates 184 and 186 which are provided with arcuate slots 184*a* and 186*a* respectively within which the heads of screws 190 and 192 are located to secure the support plate 176 in place while allowing it to pivot on the lower end of the insertion head.

It will be seen that the insertion head is provided with a cylindrical bore 196 communicating with duct 132*b* of just sufficient size to accomodate the circular vertically extending collar 164 and that the upper end of the latter is provided with three circumferentially spaced air channels 198 that communicate with radially extending air or vacuum supply ducts 200, 204 and 206.

Since the inside diameter of the can body 40 is greater than the diameter of the head 36 there is an annular space 207 between them which allows the ducts 200–206 to communicate with the inside of the can body beyond the edge of the separator plate 58 and its supporting member 176.

Slidably mounted within a suitable bore 220 in each head is a push rod 222. Its lower end is pivotally coupled by means of pin 224 to a vertically extending tab 226 on the upper surface of the tiltable support 176. The upper end of the push rod is provided with a cam follower wheel 228 and is normally biased upwardly by spring 230 which maintains the push rod at all times in contact with a horizontally disposed circular cam tract 234 that is rigidly mounted upon a fixed support bracket 226 that itself is fastened to the fixed manifold 110. The cam 234 is suitably contoured so that during most of the rotation of the turret all of the push rods are held up by the springs 230 thereby holding the support plate 176 at an oblique angle with respect to the longitudinal axis 156 of the head 36 and the corresponding aligned axis 300 of each can 40 (FIG. 1). Once the separator plate 58 is inserted the full distance a downwardly projecting lobe in the cam 234 at approximately the dotted line location 302 in FIG. 1 pivots the plate 176 to the dotted horizontal position of FIG. 4 thereby placing the separator plate 58 normal to the axis 300 of the can. The push rod is then allowed to be raised upwardly by springs 230 prior to picking up another separator.

Figure 6:
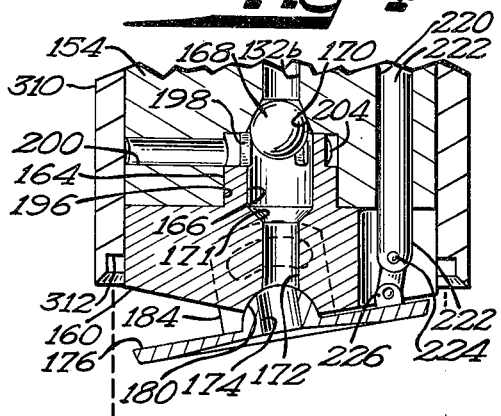
FIG. 6 is a view of the insertion head before it comes in contact with the can body when no separator is present.
Figure 6:
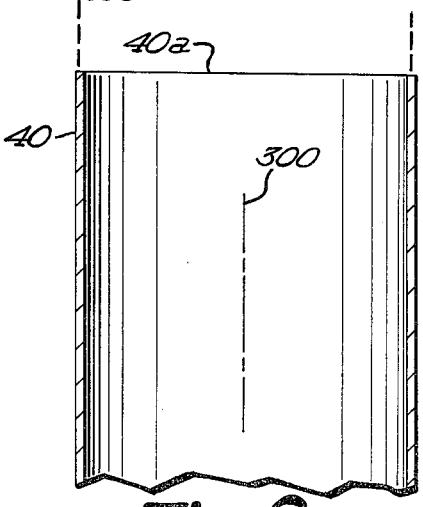

Rigidly secured to the rotating plate 131*a* adjacent each inserter head is a sleeve locating bolt 304 having a threaded lower end 306 upon which is mounted a nut 308 or other vertically adjustable member for limiting the lowermost position of a sleeve 310 which is mounted for vertical sliding movement upon the inserter head 36. The nut 308 is adjusted to locate the lower end of the sleeve 310 at its lower position somewhat below the ends of the ducts 200–206 thereby sealing them as shown in FIG. 6. The inner surface of the sleeve 310 is bored just sufficient size to slide easily over the outer surface of the inserter head 36 without excessive clearance. The lower end of the sleeve 310 is provided with a circular recess 312 of just sufficient size to accomodate the upper open end of the can body 40 during operation. The can body is raised into contact with the lower end of the inserter head by the ramp 20 (FIG. 2). Because the sleeve 310 fits closely to the outside surface of the head 36 the contact between the upper edge 40*a* and the recess 312 as shown in FIG. 4 has the effect of sealing the upper end of the can from the atmosphere so that when a vacuum is drawn through line 132*b* and the radially extending ducts 200–206 it will be transferred at certain times to the interior of the can. It should be noted at this point that the inside diameter of the can is slightly larger than that of the insertion head to provide an annular passage 207 for the flow of air between the outside of the insertion head and the inside of the can wall.

Before the operation of the apparatus is described, it will be assumed that the motor 46 is energized rotating the turret in a counterclockwise direction and the separator feeder 56 in the opposite direction.

The rotation of the feeder 56 brings each one of the separator plates 58 into alignment beneath each successive insertion head 36 where it is transferred at point A to the bottom of the insertion head by the application of vacuum applied from pipe 130 through channel 116 (FIG. 7), duct 134, duct 134*b* leading through the insertion head to hold the separator in place on the tilting support 176. As the turret continues to rotate duct 132 opens to chamber 112 and shortly thereafter channel 134 closes off from chamber 116.

If no separator 58 is present, the inward rush of air through duct 172 and 132*b* into the check valve chamber will close the check valve by seating ball 168 on seat 170 as shown in FIG. 6. Duct 132*b* communicating through opening 174 comprises a first duct and the ducts 200, 204 and 206 a second duct means for supplying vacuum. The sleeve 310 can be thought of as a movable means on the insertion head for sealing the second duct means at certain times. The sealing of duct 132*b* by ball check 168 as seen in FIG. 6 will prevent food from being inadvertantly drawn into the duct 172 should the separator 58 be missing. On the other hand, when the separator 58 is present, it will be held in place against the tilting support 176 by the vacuum exerted throughh duct 132*b* and 172 and the opening 174.

As the turret and star wheel 38 continue to rotate, the can bodies 40 will be forced upwardly by contact between their lower surfaces (covers 102) and the ramp 20. The height of the ramp 20 at its maximum rise point 22 is only sufficient to force the upper open end of the can 40*a* by that time sealed within the recess 312 of sleeve 310 beyond the ports 200–206 so that the vacuum then present within the duct 132*b* will be exerted through the ducts 200–206 which communicate through the inserter head from the duct 132*b* to the inside of the can 40 through a pathway that is not sealed by the separator when resting in contact with the free end of the head, namely, through the annular space 207 (FIG. 4) between the inside of the can body and the outside of the insertion head 36. Thus, the ramp 20 need only raise the can 40 to the position of FIG. 4 and from this point on the vacuum applied through ducts 200–206 causes the can itself and its contents to be drawn upwardly on the inserter head by virtue of the vacuum within the can body.

It will be seen that since the ducts 200–206 extend laterally from the top of the check valve chamber 166 and the ball 168 of the check valve is at the bottom of the valve, a rush of air inwardly through ducts 200–206 into duct 132*b* will not cause the ball 168 to be seated on seat 170 as would a rush of air upwardly through duct 172. When each channel 132 comes into alignment with chamber 114, the compressed air passes into the can through ducts 132*b* and passages 200, 204 and 206 thereby forcing the can off the end of the inserter head. Usually the can will fall clear by gravity alone, the compressed air being only a safety measure.

We claim:

1. A placer and tamper for a can separator plate comprising:

a. a supporting framework, b. a separator inserter head on the apparatus, said inserting head having a longitudinal axis and a free end adapted to hold one of said separator plates, c. means on the apparatus for aligning a can body having a longitudinal axis with the longitudinal axis of the inserter head, d. a means for establishing relative motion between the can body and the head along the axis of the can body and along said longitudinal axis of the head in a direction adapted to transfer the separator into the can body, e. a tiltable separator support pivotally mounted on the end of the inserter head for holding the separator at a selected angle with respect to the axis of the can body, and f. means for holding the support at an oblique angle to said axis of the head and the can at the time the separator is transferred thereinto and for moving the member normal to the can axis when the separator has reached a predetermined position within the can body.

2. A placer and tamper for a can separator plate comprising:

a. a supporting framework, b. a separator inserter head having a longitudinal axis and a free end adapted to hold one of said separator plates, c. means for aligning a can body having a longitudinal axis with the longitudinal axis of the inserter head, d. a means for establishing relative motion between the can body and the head along the axis of the can body and along said longitudinal axis of the head in a direction adapted to place the separator within the can body, e. a vacuum duct means extending through the head and communicating through openings at the free end of the head to thereby establish suction at the free end of the head when the vacuum is applied to hold one of said separator plates thereagainst to reduce the air pressure within the can to prevent the accumulation or pressurization of air under the separator plate, f. valve means for turning the vacuum on when the head is aligned with the plate to hold the separator plate on the head, and g. a means for turning the vacuum off after the head has been placed in the can body to allow withdrawal of the inserter head without removing the separator thus introduced.

3. The apparatus of claim 2 wherein a check valve means is provided within the vacuum duct means, the flow of air inwardly through said opening into the duct and through the check valve is adapted to close the check valve whereby food products, if any, within the can body will not be drawn into the duct in the event the malfunction of the apparatus causes the separator plate to be absent from the inserter head when the vacuum is applied.

4. A placer and tamper for inserting a can separator plate into a can open at one end and sealed at the other end and having a longitudinal axis, comprising:

a. a supporting framework guide, b. means for guiding can bodies fed in succession into the apparatus, c. a separator inserter head having a longitudinal axis and a free end adapted to hold one of said separator plates, plaltes, d. means for contacting and engaging the can bodies to align each can body with the longitudinal axis of the inserter head, e. a means for establishing relative motion between the can body and the head along the axis of the can body and along said longitudinal axis of the head in a direction adapted to place the separator within the can body, f. a first vacuum duct means communicating through the head with an opening in the free end of the head to hold the separator plate on the free end of the head when the vacuum is applied, g. a second duct means communicating through the head from the first duct and communicating with the inside of the can body at a location that is not sealed by the separator plate when resting in contact with the free end of the head, h. means on the head for sealing the open end of the can body when engaged on the head to prevent the flow of air thereinto when suction is applied through the second duct whereby, i. the vacuum applied in the inside of the can body through the first and second ducts causes the can to slide onto the head to thereby establish said relative motion between the head and the can body for inserting the separator plate.

5. A placer and tamper for can separator plates comprising:

a. a supporting framework, b. means for guiding can bodies into the apparatus, c. a turret mounted on the apparatus for rotation upon a predetermined axis in the apparatus, d. a plurality of separator inserter heads each having a longitudinal axis and a free end adapted to hold one of said separator plates, e. each inserter head being fixedly mounted on the turret with the longitudinal axis of each head being parallel to the turret axis and the heads being spaced circumferentially on the turret, f. means engaging the can bodies to align each can body with the longitudinal axis of the inserter head, g. a means for establishing motion of each can body relative to the head along the axis of the can body and along said longitudinal axis of the head in a direction adapted to place the separator within the can body, h. said engaging and aligning means comprising a star wheel having a plurality of pockets each aligned with the axis of one of the heads, i. a drive means operatively connected to the turret to rotate the turret, j. whereby each succeeding can body fed into the apparatus is engaged in succession within one of the pockets of the star wheel and is thereafter slid onto one of the inserter heads.

6. The apparatus of claim 4 wherein the first duct comprises a duct communicating from the free end of the inserter head to the opposite end thereof for applying a vacuum through the inserter head to the lower end thereof for at least initially securing the separator plate in contact with the lower end of the inserter head and the second duct means comprises at least one duct communicating with the side wall of the inserter head at a point located above the lower end thereof, a sealing element is slidably mounted upon the outside of the inserter head to initially seal the second duct means and the upward sliding movement of the can body over the inserter head being adapted to raise said slidably mounted sealing element to thereby provide communication from the second vacuum duct means to the inside of the can to thereby cause the vacuum thus produced within the can to slide the can upwardly on the inserter head until the separator plate has reached the desired position within the can body.

7. The apparatus of claim 1 wherein a cam means is provided on the apparatus, a push rod extends through the inserter head and is slidably mounted therein, said push rod is operatively connected to the tiltable separator support at one end and being operatively engaged with said cam means at the other end to tilt the support and orient the separator plate at an oblique angle with respect to the longitudinal axis of the inserter head and the aligned can body while the plate is inserted and for orienting the separator support normal to the longitudinal axis of the inserter head when the separator plates have been inserted to a predetermined position in the cans.

* * * * *